US007258071B2

(12) United States Patent
Shoji

(10) Patent No.: US 7,258,071 B2
(45) Date of Patent: Aug. 21, 2007

(54) EMBROIDERY FRAME TRANSFER DEVICE AND ATTACHMENT

(75) Inventor: Yoshihisa Shoji, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 861 days.

(21) Appl. No.: 10/467,462

(22) PCT Filed: Jan. 30, 2002

(86) PCT No.: PCT/JP02/00678

§ 371 (c)(1),
(2), (4) Date: Aug. 7, 2003

(87) PCT Pub. No.: WO02/064873

PCT Pub. Date: Aug. 22, 2002

(65) Prior Publication Data

US 2005/0072346 A1 Apr. 7, 2005

(30) Foreign Application Priority Data

Feb. 9, 2001 (JP) ..... 2001-034185

(51) Int. Cl.
*D05C 9/04* (2006.01)
*D05C 9/00* (2006.01)

(52) U.S. Cl. ..... 112/470.18; 112/103; 38/102.2

(58) Field of Classification Search ..... 112/103, 112/102.5, 117, 118, 119, 470.06, 470.09, 112/470.18; 38/102.2
See application file for complete search history.

(56) References Cited

U.S. PATENT DOCUMENTS 4,479,446 A * 10/1984 Johnson et al. ..... 112/102.5
4,763,586 A * 8/1988 Takenoya et al. ..... 112/470.06
5,291,843 A * 3/1994 Hori ..... 112/103
5,555,828 A * 9/1996 Rowley ..... 112/103
5,630,370 A * 5/1997 Herbach ..... 112/103
5,899,155 A * 5/1999 Thoren ..... 112/103
6,164,224 A 12/2000 Tachikawa et al.
6,336,416 B1 * 1/2002 French et al. ..... 112/103
7,089,873 B2 * 8/2006 Yoshida ..... 112/103
7,168,378 B2 * 1/2007 Fukao ..... 112/103

FOREIGN PATENT DOCUMENTS

JP A 63-203187 8/1988
JP A 8-188956 7/1996
JP B2 2757166 3/1998
JP B2 3008705 12/1999
JP A 2002-52280 2/2002

* cited by examiner

*Primary Examiner*—Ismael Izaguirre
(74) *Attorney, Agent, or Firm*—Oliff & Berridge, PLC

(57) ABSTRACT

An attachment 52 comprises: a carriage connecting section 74 connected to a carriage 12 of an embroidery frame transfer device 4; and a metal fastener fixed to an attaching block 32 at the right-hand end portion of the carriage connecting section 74 and having a connecting section of a nonstandard embroidery frame 51 connected thereto. By connecting a connecting section 66 of the nonstandard embroidery frame 51 to the metal fastener 75 of the attachment 52 and by connecting the carriage connecting section 74 of the attachment 52 to the carriage 12, the nonstandard embroidery frame 51 can be mounted indirectly on the carriage 12. Thus, the nonstandard embroidery frame 51 of the type different in construction for attachment to the carriage 12 can be connected to the carriage 12.

12 Claims, 14 Drawing Sheets

EMBROIDERY FRAME TRANSFER DEVICE AND ATTACHMENT

TECHNICAL FIELD

The present invention relates to an embroidery frame transfer device having a transfer mechanism for transferring a carriage, on which an embroidery frame for holding a cloth to be embroidered is mounted, in two orthogonal directions, and an attachment for mounting the embroidery frame indirectly on the carriage.

BACKGROUND ART

Generally, the embroidery frame transfer device is provided with: an embroidery frame for holding a cloth to be embroidered; a carriage capable of mounting/demounting the embroidery frame; a Y-direction transfer mechanism for moving the carriage in the widthwise direction (or Y-direction) of a machine head portion; and an X-direction transfer mechanism for moving the carriage together with the Y-direction transfer mechanism in the longitudinal direction (or X-direction) of the machine head portion. By executing the sewing actions while moving the embroidery frame in the X- and Y-directions by the embroidery frame transfer device, an embroidery pattern is formed on the cloth.

In this case, various sizes and shapes are provided for the embroidery frame so that the user mounts an embroidery frame of a suitable kind according to the size, shape or the like of the cloth or the embroidery pattern to the carriage.

DISCLOSURE OF THE INVENTION

Here, the embroidery frame transfer device has been practiced with a structure for mounting various types of embroidery frames. For the operations to mount and demount the embroidery frame on and from the carriage and for the preventions of the embroidery frame from coming out, on the other hand, improvements have been made in the structure for mounting the embroidery frame on the carriage, such as in a mechanism for engaging or locking the carriage and the embroidery frame. Therefore, the embroidery frame transfer devices of the old and new kinds may be different in the mounting structure of the embroidery frame.

Thus, the embroidery frame transfer devices of different mounting structures of the embroidery frames have no interchangeability between the embroidery frames. In case the user changed the embroidery frame transfer device so that the embroidery frame mounting structure of the embroidery frame transfer device of the new kind purchased is different from that of the embroidery frame transfer device of the old kind owned, therefore, there arises a disadvantage that the embroidery frame for the old kind accustomed by the user cannot be used in the embroidery frame transfer device of the new kind.

Especially in case the embroidery frame transfer device of the new kind is not provided with the embroidery frame of the same type as that accustomed by the user for the old one, the user has to substitute it with an embroidery frame of another type.

Therefore, an object of the present invention is to provide an embroidery frame transfer device, which is provided with an attachment capable of connecting an embroidery frame of the type different for attachment to the carriage, and that attachment.

An embroidery frame transfer device comprising: a carriage including an attaching portion, the carriage capable of attaching a standard embroidery frame and a nonstandard embroidery frame, each frame including a connecting section that connects directly or indirectly to the attaching portion of the carriage and a frame portion for holding a cloth to be embroidered;

an attachment for mounting on the attaching portion a nonstandard embroidery frame having a connecting section of a structure different from that of the connecting section of the standard embroidery frame so that it cannot be connected directly to the attaching portion of the carriage: the attachment including: a frame attaching portion that connects to the connecting section of the nonstandard embroidery frame, and a carriage connecting section that connects to the frame attaching portion and the attaching portion of the carriage.

According to the aforementioned construction, even the nonstandard embroidery frame having a different structure for attachment to the carriage can be mounted on the carriage of the embroidery frame transfer device through the attachment.

BEST MODE FOR CARRYING OUT THE INVENTION

Figure 1:
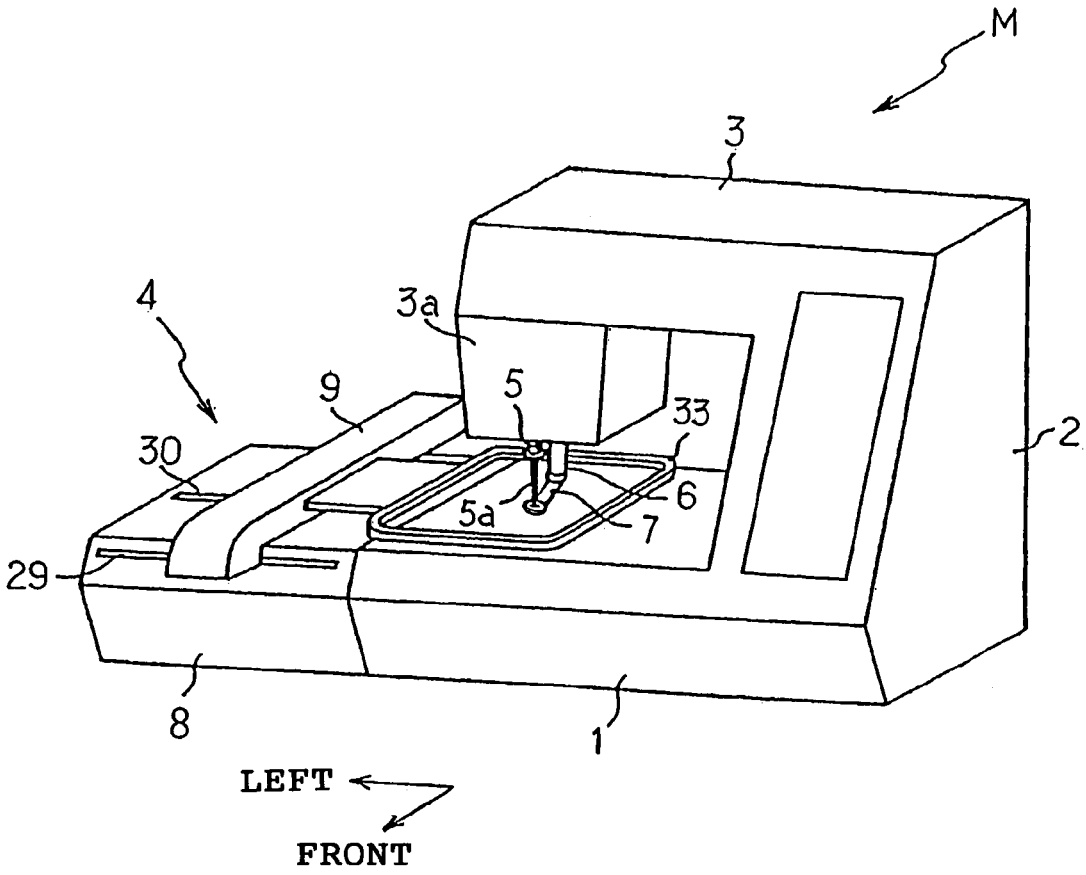
FIG. 1 is a perspective view showing the exterior of an electronic control type embroidering machine according to one embodiment of the present invention.

One embodiment of the present invention will be described with reference to the accompanying drawings. The present embodiment is applied to an electronic control type embroidering machine capable of sewing various embroidery patterns. First of all, in FIG. 1 showing the entire construction of the electronic control type embroidering machine, an embroidering machine M is provided with a bed 1, a column 2 erected at the right-hand end portion of the bed 1, and an arm 3 extending leftward from the upper end portion of the column 2 to confront the bed 1. At the left-hand end portion of the bed 1, there is disposed a free arm, on which an embroidery frame transfer device 4 is removably mounted.

At the head 3*a* of the arm 3, a needle bar 5 supporting a needle 5*a* and a presser bar 6 are supported vertically movably. The presser bar 6 is provided with a presser foot 7 at its lower end portion.

The bed 1 is provided therein with a thread catcher made of a rotating hook, although not shown. Moreover, the embroidering machine M is provided with a machine motor, a needle bar driving mechanism for driving the needle bar 5, a thread take-up lever, a thread take-up lever driving mechanism for driving the thread take-up lever, and a hook driving mechanism for driving the rotating hook. By these drive mechanisms, the drive force of the machine motor is transmitted to the needle bar, the thread take-up lever and the rotating hook so that the thread catcher and the needle 5*a* cooperate to interlace the upper thread and the lower thread to form stitches in the cloth to be embroidered.

The embroidery frame transfer device 4 will be described in the following. Here, this embroidery frame transfer device 4 has a construction substantially identical to that which is described in Japanese Patent Application No. 2000-244071 filed by the present Applicant. Of the embroidery frame transfer device 4, therefore, the portion relating to the gist of the present invention will be described in detail, but the description of the remaining portion will be omitted or briefly made.

Figure 2:
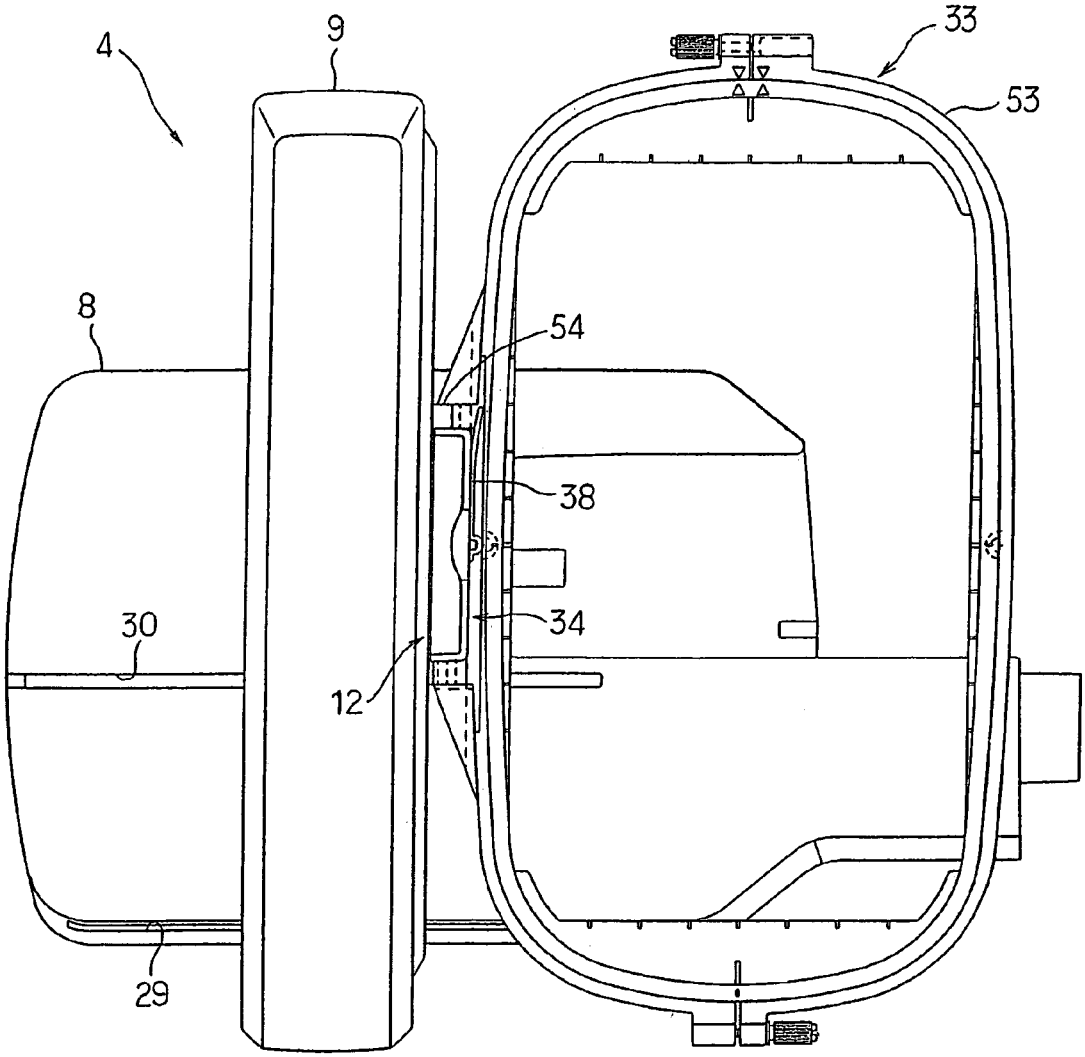
FIG. 2 is a top plan view showing an embroidery frame transfer device having a standard embroidery frame mounted thereon.
Figure 3:
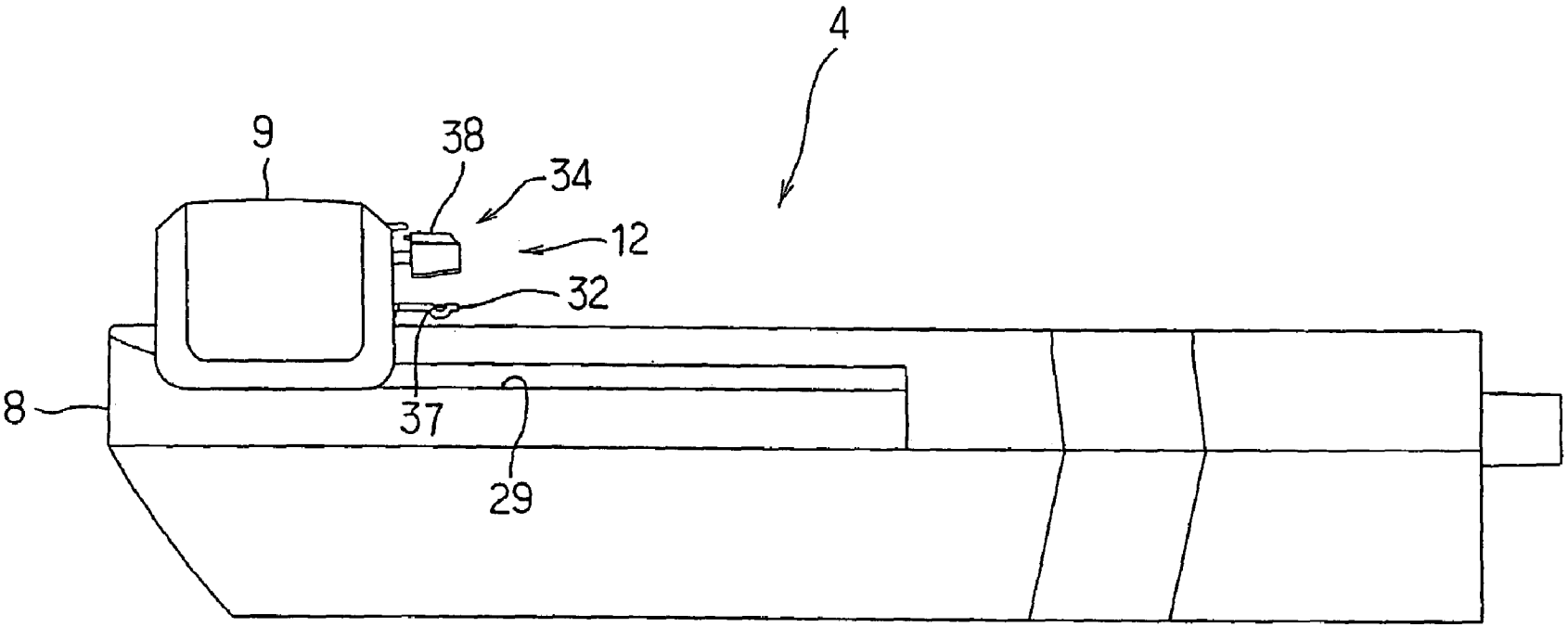
FIG. 3 is a front elevation of the embroidery frame transfer device.
Figure 4:
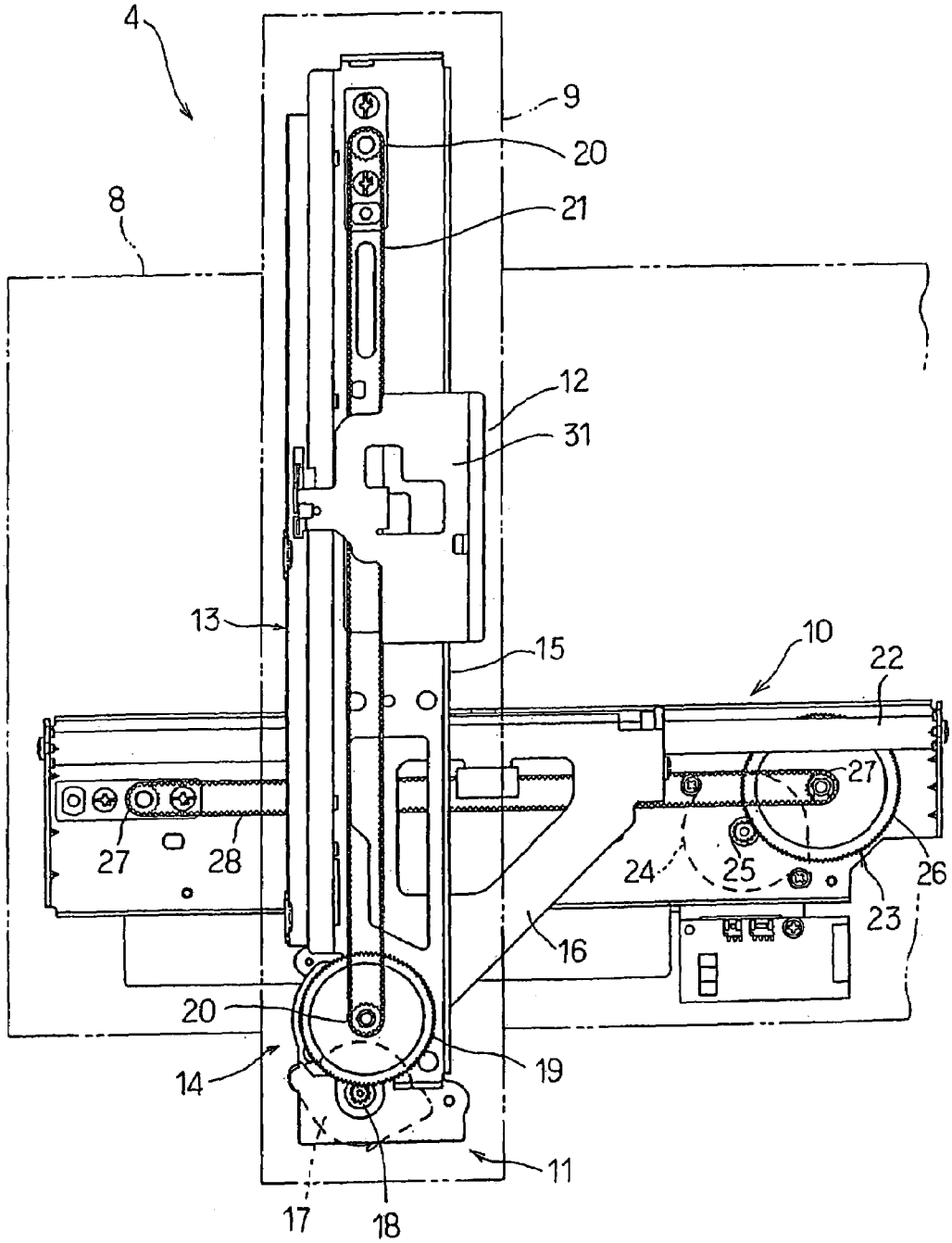
FIG. 4 is a top plan view of an X-direction transfer mechanism and a Y-direction transfer mechanism of the embroidery frame transfer device.

As shown in FIGS. 2 to 4, the embroidery frame transfer device 4 is constructed to include a body case 8 and a movable case 9, which is arranged long in the longitudinal direction over the body case 8 and which can move in the transverse direction. The body case 8 houses an x-direction transfer mechanism 10 therein. On the other hand, the movable case 9 is constructed to have its front and rear end portions extended from the body case 8, and houses a Y-direction transfer mechanism 11 and a portion of a carriage 12 therein.

The Y-direction transfer mechanism 11 includes a Y-direction frame 13 for guiding and supporting the carriage 12 movably in the longitudinal direction, and a Y-direction drive line 14 mounted on the Y-direction frame 13 for moving the carriage 12 in the longitudinal direction. The Y-direction frame 13 is constructed of a longitudinally long frame body 15, and an auxiliary frame 16 fixed on the lower portion of the frame body 15. The Y-direction drive line 14 includes a Y-direction motor 17, a drive gear 18, a larger gear 19, a pair of pulleys 20 and a timing belt 21. The carriage 12 is connected to the timing belt 21. With this construction, the drive force of the Y-direction motor 17 is transmitted through the timing belt 21 to the carriage 12 so that the carriage 12 is driven in the longitudinal direction.

The X-direction transfer mechanism 10 includes an X-direction frame 22 for guiding and supporting the Y-direction frame 13 movably in the transverse direction, and an X-direction drive line 23 mounted on the X-direction frame 22 for driving the Y-direction frame 13 in the transverse direction. The X-direction drive line 23 includes an X-direction motor 24, a drive gear 25, a larger gear 26, a pair of pulleys 27 and a timing belt 28, to which the auxiliary frame 16 is connected.

In the side wall and the upper wall of the body case 8, on the other hand, there are formed a pair of transversely long slits 29 and 30. The frame body 15 of the Y-direction frame 13 is connected to the leading end portion of the auxiliary frame 16, the leading end portion and the trailing end portion of which are movably inserted into those slits 29 and 30. With the construction thus made, the Y-direction frame 13 is driven transversely along the slits 29 and 30 when the drive force of the X-direction motor 24 is transmitted to the auxiliary frame 16.

Figure 5B:
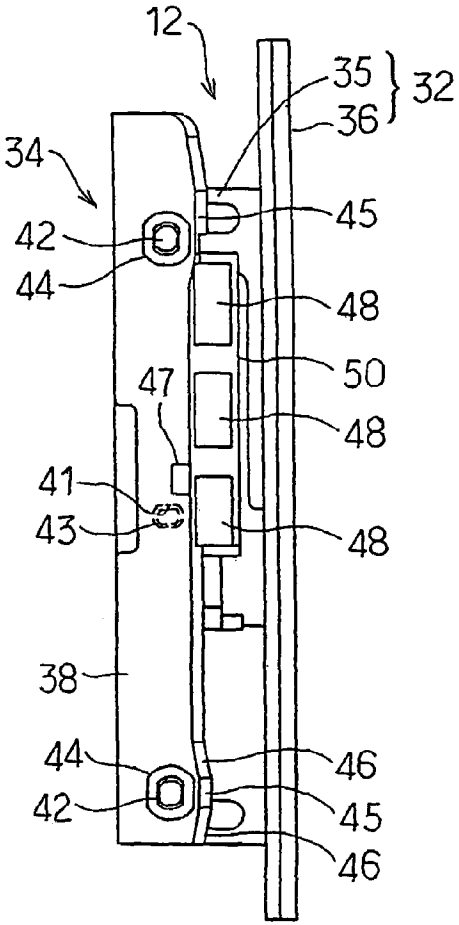
FIG. 5B is a right-hand side view of the carriage.
Figure 5A:
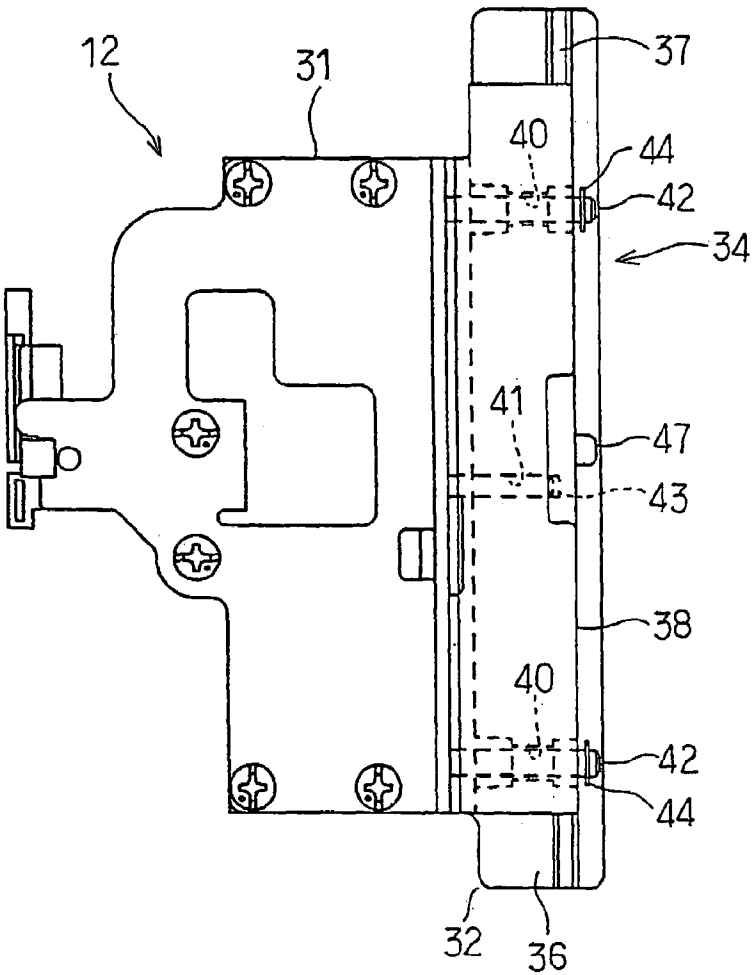
FIG. 5A is a top plan view of a carriage.
Figure 6B:
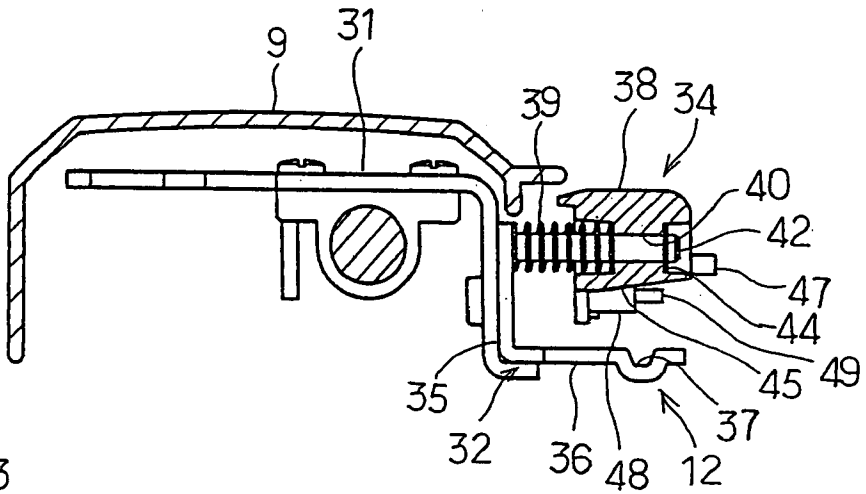
FIGS. 6A and 6B are longitudinal sections of peripheral portions of the carriage.
Figure 6A:
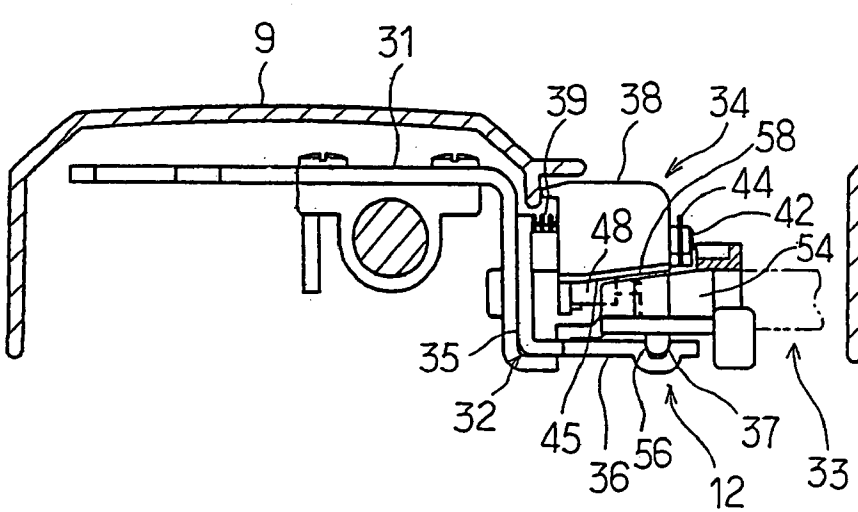
Figure 7:
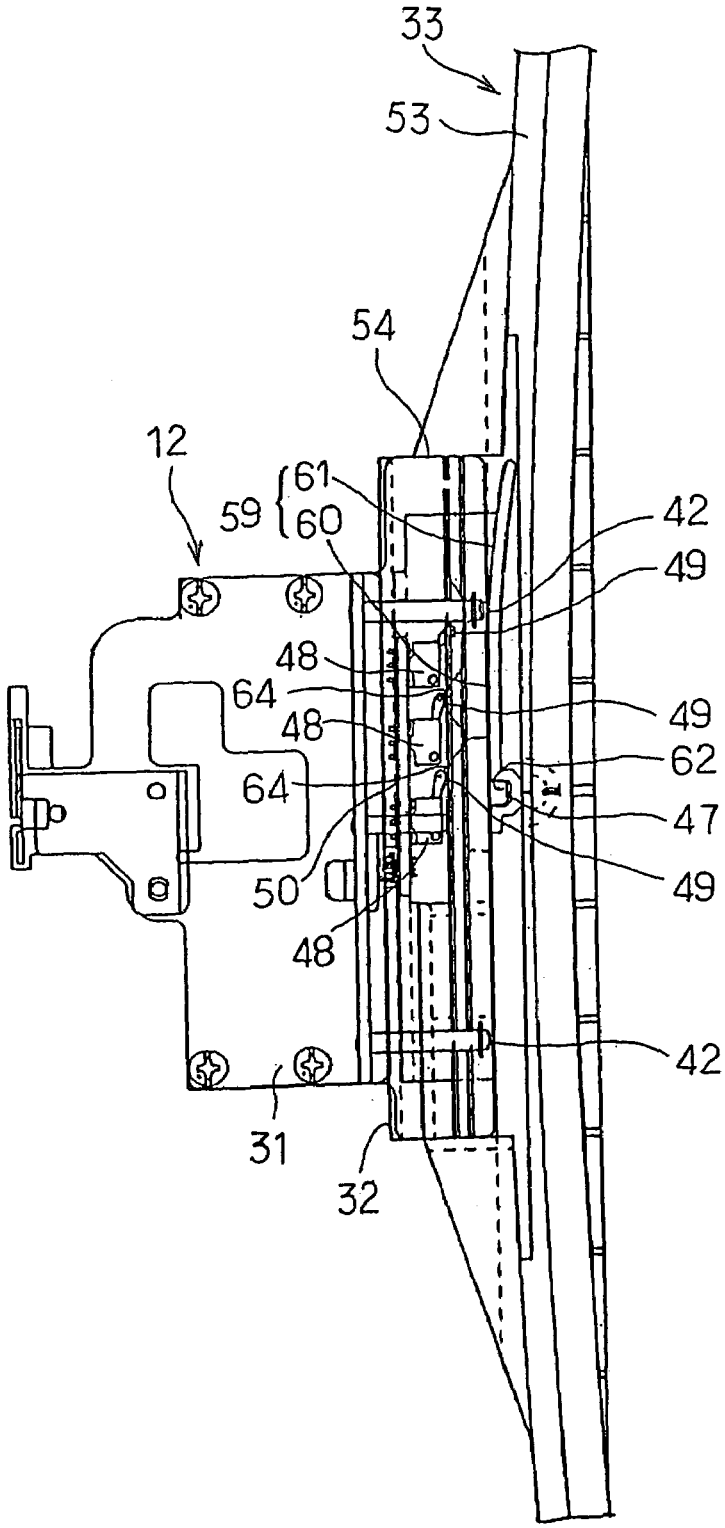
FIG. 7 is a top plan view of the carriage and a portion of the embroidery frame.

As shown in FIGS. 5 to 7, moreover, the carriage 12 is constructed to include: a guided member 31 to be guided by the Y-direction frame 13; an attaching block 32 or an attaching portion fixed to the right-hand end portion of the guided member 31 by means of screws; and a lock mechanism 34 for locking a standard embroidery frame 33 and an attachment 52, as will be described hereinafter, removably to the carriage 12. The attaching block 32 includes an upright wall 35, and an overhang 36 extended rightward from the lower end portion of the upright wall 35. The overhang 36 is made longer in the longitudinal direction than the upright wall 35. In the upper face of the overhang 36, there is formed an engaging groove 37, which is extended in the longitudinal direction.

The lock mechanism 34 includes a lock member 38 guided and supported movably in the transverse direction by the upright wall, and a pair of compression coil springs 39 acting as bias members for biasing the lock member 38 rightward.

The lock member 38 has a longitudinal length substantially equal to that of the upright wall 35 and is arranged over the overhang 36. A pair of first guide holes 40 are formed near the two longitudinal end portions of the lock member 38, and a second guide hole 41 is formed near the longitudinal center. Into these first and second guide holes 40 and 41, respectively, there are inserted first guide pins 42 and a second guide pin 43. These first and second guide pins 42 and 43 are fixed at their left end portions individually in the upright wall 35; With the construction thus made, the lock member 38 is guided movably in the transverse direction by the guide pins 42 and 43.

On the other hand, the compression coil springs 39 are mounted around the first guide pins 42 between the upright wall 35 and the lock member 38. Moreover, circlips 44 are mounted on those right-hand end portions of the first guide pins 42, which are projected rightward from the lock member 38. As a result, the lock member 38 is prevented from being removed from the guide pins 42 and 43 by the biasing forces of the compression coil springs 39. With the construction thus made, the lock member 38 is biased rightward by the compression coil springs 39.

At the two longitudinal end portions of the lower face of the lock member 38, there are individually formed sliding faces 45 and 45. These sliding faces 45 and 45 are sloped downward from the right-hand side to the left-hand side. At the front and rear portions of the right-hand side sliding face 45, on the other hand, there are individually formed a pair of taper guide portions 46 and 46. These taper guide portions 46 and 46 are sloped to merge into the sliding faces 45 and to rise to the higher positions as they leave the sliding faces 45 the farther. Moreover, a positioning projection 47 is disposed at the longitudinally central portion of the right-hand face of the lock member 38.

At the lower portion of the lock member 38, still moreover, there are longitudinally juxtaposed a plurality of, e.g., three detection switches 48 for detecting the kind of the embroidery frame 33. These detection switches 48 are made of ON/OFF switches having detect levers 49. On the left-hand end face of the lock member 38, there is fixed a longitudinally long substrate 50, to which the detection switches 48 are fixed and electrically connected.

Here, the embroidery frame transfer device 4 thus constructed is provided with not only the standard embroidery frame 33, which can be directly mounted on the carriage 12, but also the attachment 52 for mounting a nonstandard embroidery frame 51, as could not otherwise be mounted, indirectly on the carriage 12. At first, the construction of the standard embroidery frame 33 will be described with reference to FIGS. 2 and 6 to 8.

Specifically, the standard embroidery frame 33 includes a cloth attaching frame portion 53 for holding the cloth (not shown) to be embroidered, and a connecting section 54 to be connected to the carriage 12. This carriage 12 is provided with a plurality of kinds of removable standard embroidery frames 33 having the cloth attaching frame portions 53 of different sizes and shapes. For example, FIG. 8 shows three kinds of standard embroidery frames 33: (a) presents the standard embroidery frame 33 having the cloth attaching frame 53 of about 260×160 (i.e., the longitudinal length [mm]×the transverse length [mm], as in the following); (b) presents the standard embroidery frame 33 having the cloth attaching frame 53 of about 100×100; and (c) presents the standard embroidery frame 33 having the cloth attaching frame 53 of about 40×60.

On the other hand, the connecting sections 54 of the individual standard embroidery frames 33 are given such substantially identical constructions as can slide to come into and out of engagement between the overhang 36 of the carriage 12 and the lock member 38. In this case, in the small-sized standard embroidery frames 33 shown in FIGS. 8B and 8C, for example, the connecting sections 54 and the cloth attaching frame portions 53 are so connected by joint portions 55 of various lengths that the centers of the cloth attaching frame portions 53 of the standard embroidery frames 33 mounted on the carriage 12 at the position of an origin may be located at a predetermined position (e.g., at the position of the needle 5*a*).

On the other hand, the connecting section 54 is provided on its lower face with a longitudinally long engaging projection 56. This engaging projection 56 comes into engagement with the engaging groove 37 when the connecting section 54 is slid and mounted between the overhang of the carriage 12 and the lock member 38. Moreover, the wall portion is formed, although not shown, at the front end portion on the lower face of the connecting section 54. The wall portion allows the connecting section 54 to be mounted only from the front side on the carriage 12.

At the substantially right-hand half of the upper face of the connecting section 54, moreover, there is formed a stepped portion 57, which is provided on its upper face with a contact face 58 sloping gently downward from the right-hand side to the left-hand side. When the connecting section 54 is mounted on the carriage 12, the sliding faces 45 of the lock member 38 come into sliding engagement with the contact face 58 to push the connecting section 54 downward.

At the right-hand end portion of the upper face of the stepped portion 57, still moreover, there is disposed a guide portion 59 for guiding and switching the lock member 38 into a released position when the connecting section 54 is mounted on the carriage 12. This guide portion 59 is formed at the rear portion of the longitudinally central portion of the connecting section 54, and its front end portion is formed as a straight guide portion 60 whereas its rear end portion is formed as a curved guide portion 61, which is gently curved rightward. At the front end portion of the guide portion 59, on the other hand, there is formed a positioning recess 62, which corresponds to the positioning projection 47 of the lock member 38.

When the connecting section 54 is mounted on the carriage 12, the positioning projection 47 comes into engagement with the positioning recess 62, and the connecting section 54 is so locked by the carriage 12 as cannot slide. As a result, the positioning is made in the state where the longitudinally central portion of the connecting section 54 and the longitudinally central portion of the attaching block 32 of the carriage 12 are substantially aligned with each other.

In the left-hand side portion of the stepped portion 57, on the other hand, there are formed cutout recesses 63, which are provided with detected portions 64 to be detected by the detect switches 48 of the carriage 12. The detected portions 64 are formed of projections on the side of the detect levers 49, i.e., on the left-hand side so that the detect switches 48 are turned ON by the detected portions 64 when the standard embroidery frame 33 is mounted on the carriage 12. The connecting section 54 can be provided with such three detected portions 64 at the maximum as to correspond to the detect switches 48, and one to three detected portions 64 are arranged in an intrinsic pattern of arrangement for every kinds of the standard embroidery frames 33.

Figure 8C:
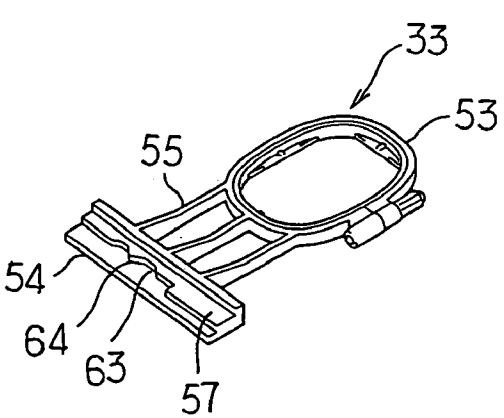
FIGS. 8A to 8C are perspective views showing one example of the standard embroidery frame.
Figure 8B:
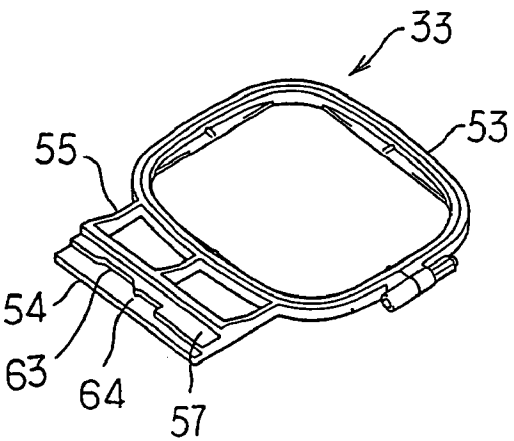
Figure 8A:
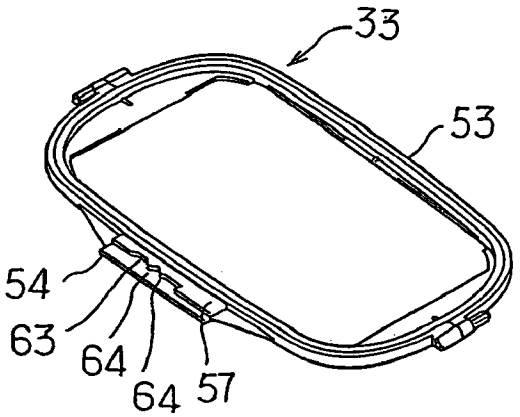

For example, the standard embroidery frame 33 of FIG. 8A is provided with the two detected portions 64 at the front position and at the intermediate position; the standard embroidery frame 33 of FIG. 8B is provided with the single detected portion 64 at the front position; and the standard embroidery frame 33 of FIG. 8C is provided with the single detected portion 64 at the intermediate position. With this construction, it is possible to detect whether or not the standard embroidery frame 33 is mounted and to detect the standard embroidery frames 33 of seven kinds.

Here will be described how to mount and demount the standard embroidery frame 33 on and from the carriage 12. In the state where the standard embroidery frame 33 is not mounted on the carriage 12, as shown in FIG. 6B, the lock member 38 biased rightward by the compression coil springs 39 is retained at the right-hand limit position by the circlips 44. From this state, the connecting section 54 of the standard embroidery frame 33 is inserted from the front side into the clearance between the overhang 36 of the carriage 12 and the lock member 38. And, the engaging projection 56 of the connecting section 54 is brought into engagement with the engaging groove 37 to slide the connecting section 54 backward.

At this time, the front end portion of the guide portion 59 of the connecting section 54 is located to the right of the right-hand end portion of the positioning protrusion 47 of the lock member 34 at the right-hand limit position. As a result, the guide portion 59 to move backward does not collide against the positioning projection 47, but the curved guide portion 61 comes into engagement with the positioning projection 47 to push the positioning protrusion 47 leftward thereby to switch the lock member 34 to the released position so that the straight guide portion 60 comes into engagement with the positioning projection 47 to hold the lock member at the released position.

In the state where the positioning projection 47 is brought into engagement with the guide portion 59 so that the lock member 34 is switched to the released position, the standard embroidery frame 33 reaches a mounted position, when the connecting section 54 is further slid backward. Then, the lock member 34 is moved rightward by the biasing force of the compression coil springs 39 so that the positioning projection 47 comes into engagement with the positioning recess 62. At the same time, the paired sliding faces 45 of the lock member 34 slides on and engages with the paired contact faces 58 of the connecting section 54 to push and lock the connecting section 54 to and on the carriage 12.

Here in the state where the lock member 34 is pushed leftward by the operator into the released position against the biasing force of the compression coil springs 39, the standard embroidery frame 33 can be demounted from the carriage 12 by releasing the positioning projection 47 and the positioning recess 62 from their engagement to slide the standard embroidery frame 33 forward.

Figure 9:
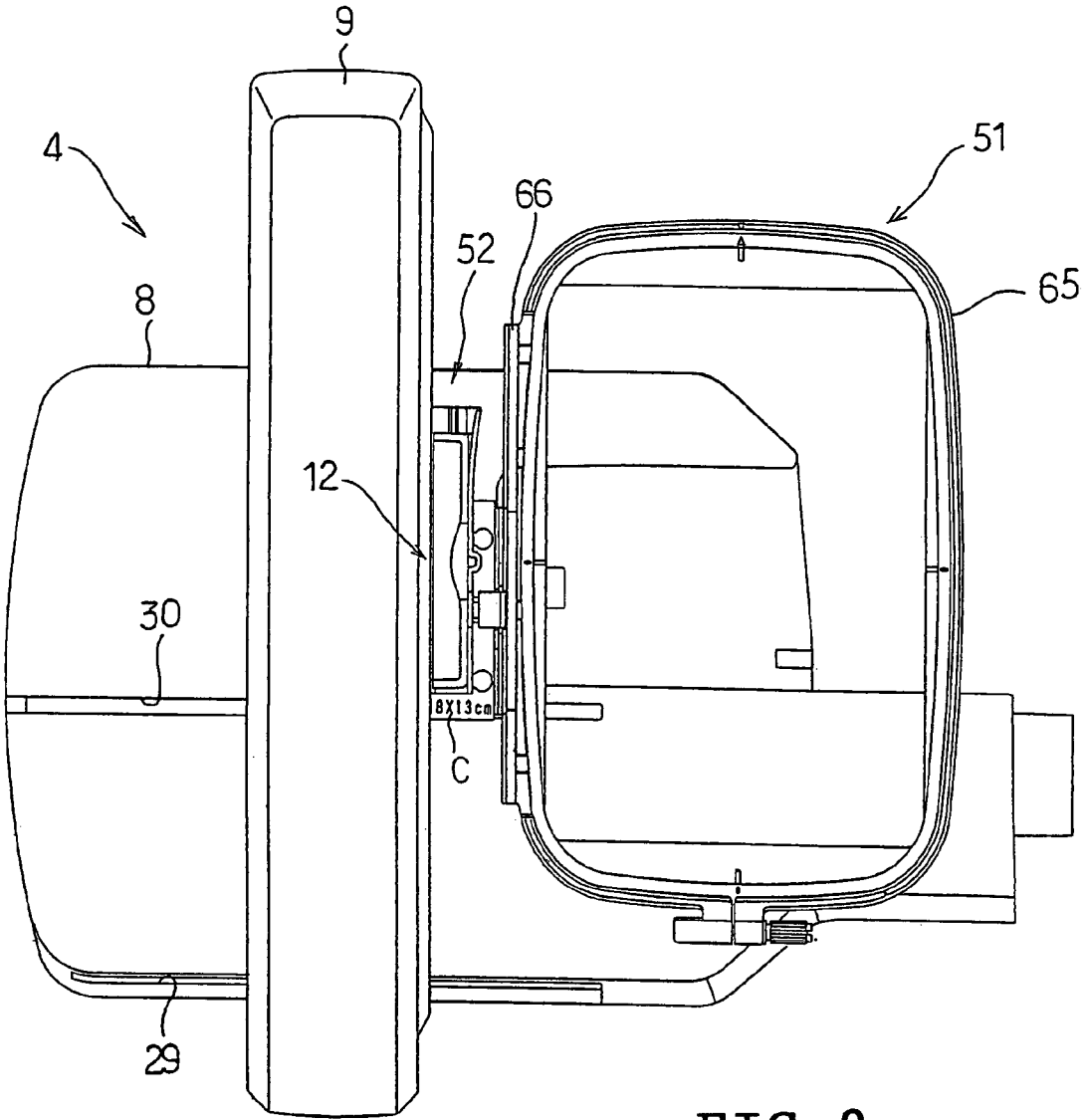
FIG. 9 is a top plan view of the embroidery frame transfer device having a nonstandard embroidery frame mounted thereon through an attachment.
Figure 10:
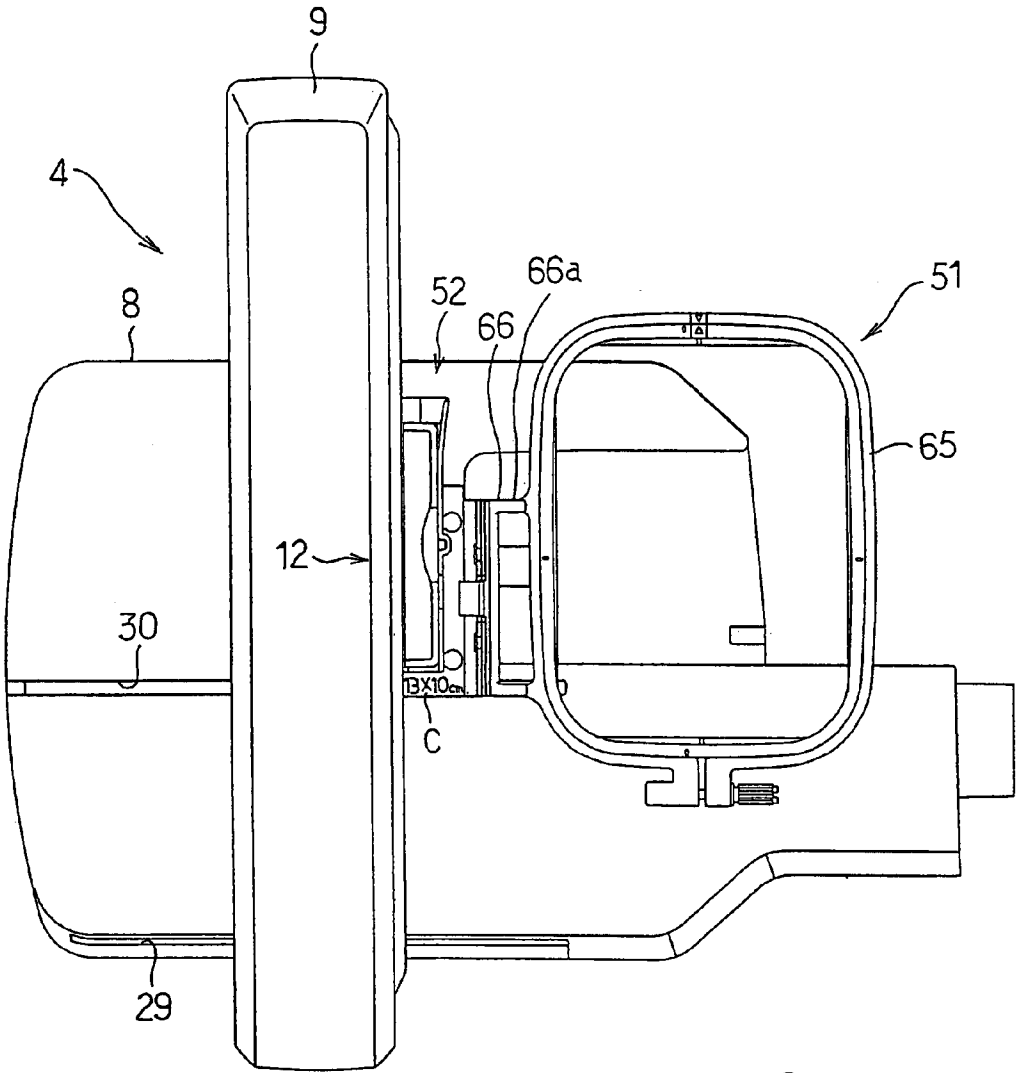
FIG. 10 is a top plan view of the embroidery frame transfer device having the nonstandard embroidery frame mounted thereon through an attachment.
Figure 11:
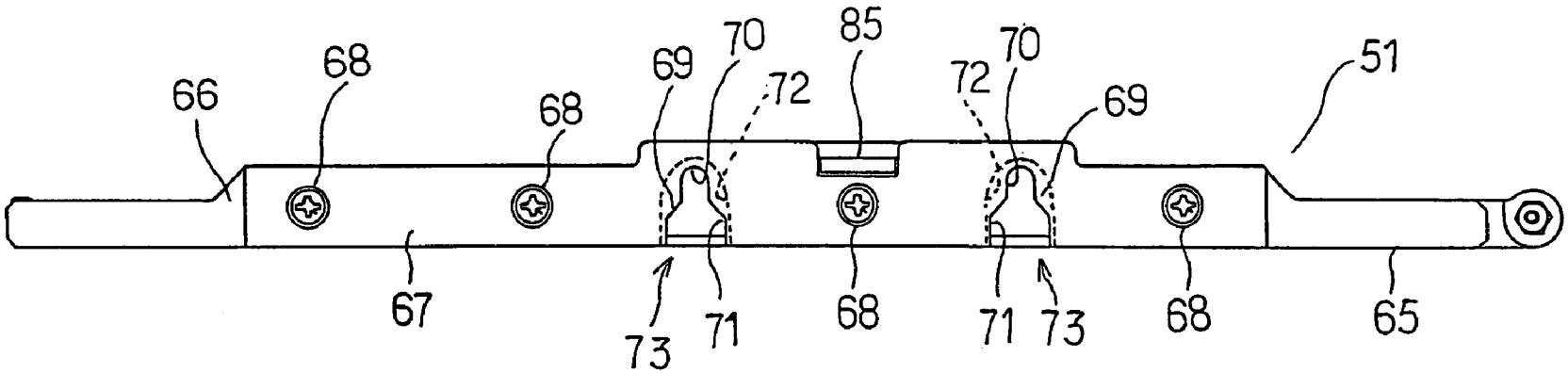
FIG. 11 is a left-hand side view of the nonstandard embroidery frame.
Figure 12:
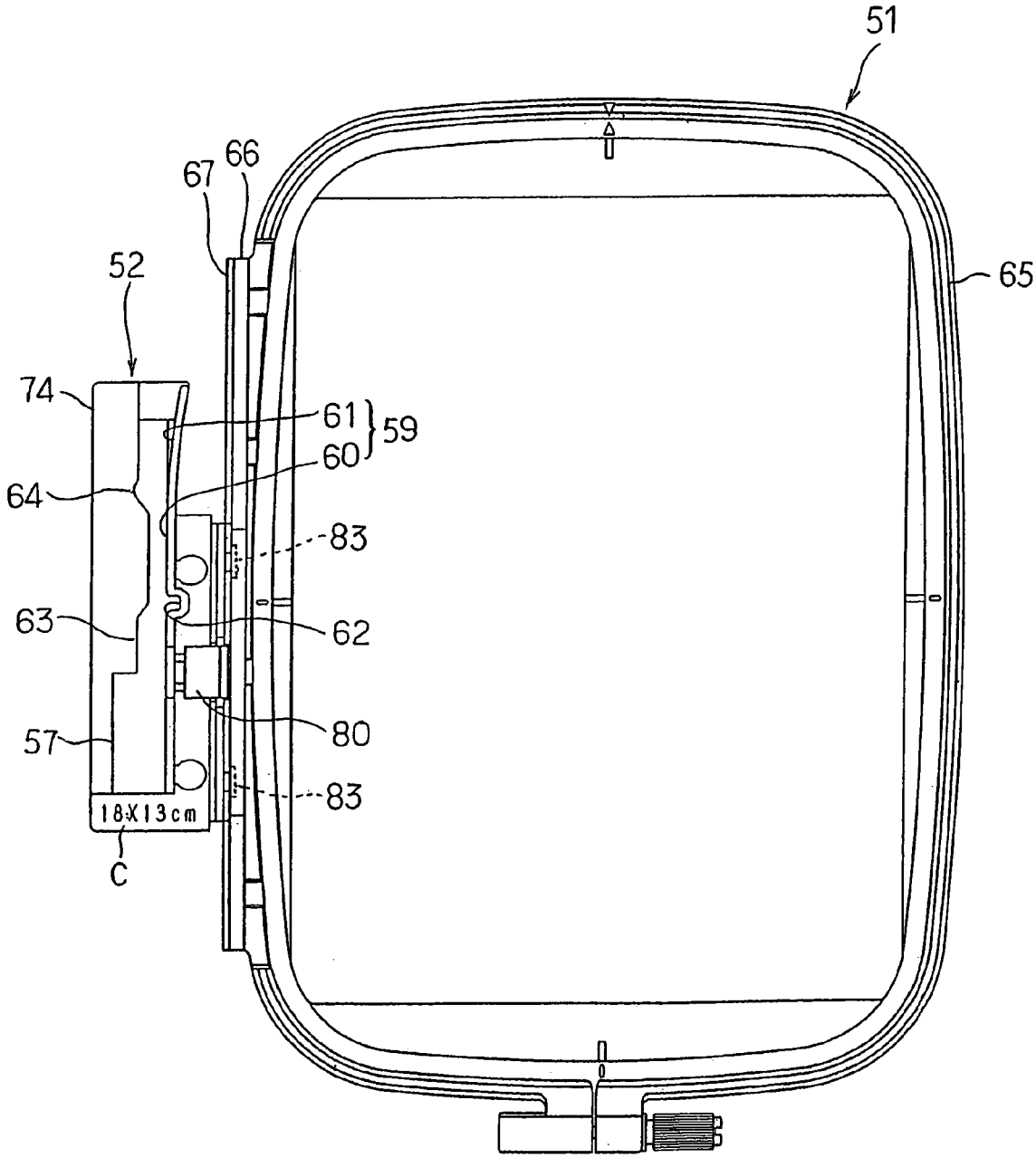
FIG. 12 is a top plan view showing the nonstandard embroidery frame connected to the attachment.
Figure 13A:
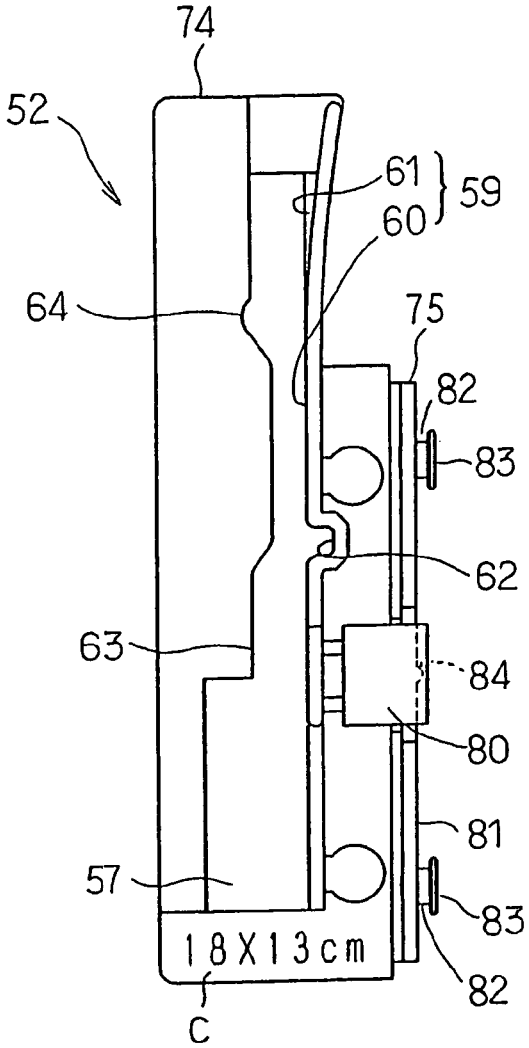
FIG. 13A is a top plan view of the attachment.
Figure 13C:
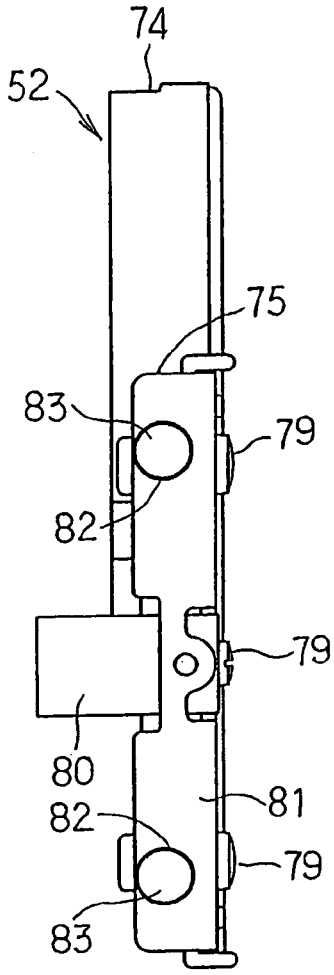
FIG. 13C is a right-hand side view of the attachment.
Figure 13B:
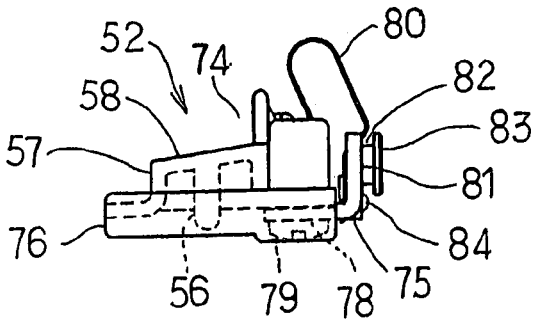
FIG. 13B is a front elevation of the attachment.
Figure 14:
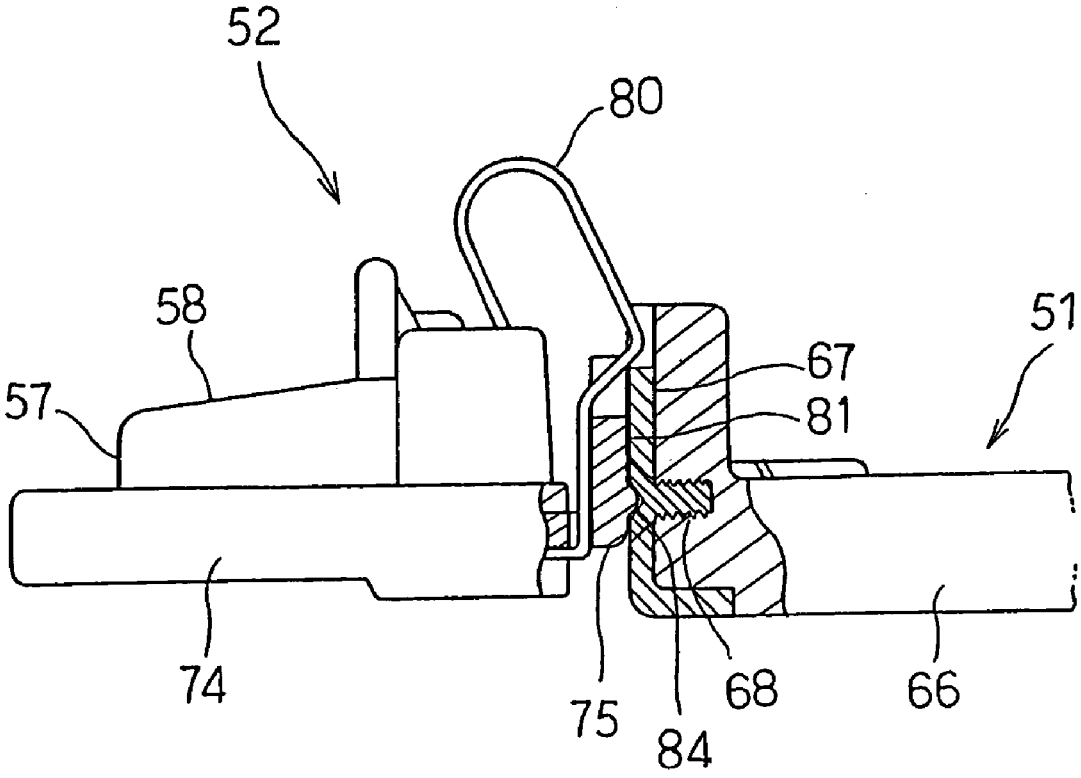
FIG. 14 is an enlarged section of the attachment and a portion of the nonstandard embroidery frame.

On the contrary: FIGS. 9 and 10 are top plan views showing the state, in which the nonstandard embroidery frame 51 is mounted on the carriage 12 through the attachment 52; FIG. 11 is a left-hand side elevation of the nonstandard embroidery frame 51; FIG. 12 is a top plan view showing the state, in which the nonstandard embroidery frame 51 is connected to the attachment; FIG. 13A is a top plan view of the attachment 52; FIG. 13B is a front elevation; FIG. 13C is a right-hand side elevation; and FIG. 14 is an enlarged section of the attachment 52 and a portion of the nonstandard embroidery frame 51.

As shown in FIGS. 9 to 11, the nonstandard embroidery frame 51 is constructed to include a cloth attaching frame portion 65 for holding the cloth to be embroidered, and a connecting section 66 disposed at the left-hand end portion of the cloth attaching frame portion 65. As the nonstandard embroidery frame 51, there are a plurality of kinds of embroidery frames having the cloth attaching frame portions 65 of different sizes (i.e., sewing ranges) and shapes. For example, FIG. 9 presents the nonstandard embroidery frame 51 having the cloth attaching frame portion 65 of about 180×130 (i.e., the longitudinal length [mm]×the transverse length [mm], as in the following), and FIG. 10 presents the nonstandard embroidery frame 51 having the cloth attaching frame portion 65 of about 130×100. Here, the nonstandard embroidery frame 51 to be mounted on the carriage 12 through the attachment 52 is made smaller in the size of its cloth attaching frame portion 65 than that 53 of the standard embroidery frame 33.

On the other hand, the connecting sections 66 of the individual nonstandard embroidery frames 51 have substantially identical constructions. Specifically, a longitudinally long band-shaped engaging plate 67 is fixed to the left-hand end face of the connecting section 66 by means of a plurality of screws 68. The number and arrangement of the screws 68 are different according to the sizes of the cloth attaching frame portion 65 of the nonstandard embroidery frame 51. In the case of the nonstandard embroidery frame 51 having the cloth attaching frame portion 65 of the size of about 180×130 mm, the four screws 68 are arranged at substantially equal intervals, as shown in FIG. 11.

In the engaging plate 67, moreover, there are formed a plurality of, e.g., two cutout portions 69 at a predetermined spacing. Each of these cutout portions 69 is composed of a first cutout portion 70 forming part of an ellipse, and a second guiding cutout portion 71 merging into the lower end of the first cutout portion 70 and made wider than the first cutout portion 70.

At those portions of the connecting section 66 which correspond to the cutout portions 69, moreover, there are individually formed cutout recesses 72, which have their lower ends opened. And, the cutout portions 69 and the cutout recesses 72 form two engaging recesses 73. On the end face of the connecting section 66 between the engaging recesses 73, still moreover, there is formed a ridge portion 85, which projects outward.

It is apparent from the construction thus far made that the nonstandard embroidery frame 51 cannot be directly mounted on the carriage 12 of the embroidery frame transfer device 4. In other words, the nonstandard embroidery frame 51 can be directly mounted on the carriage of the not-shown dedicated embroidery frame transfer device. As in the aforementioned standard embroidery frame 33, in the small-sized nonstandard embroidery frame 51 shown in FIG. 10, for example, the connecting section 66 and the cloth attaching frame portion 65 are so connected by joint portions 66*a* of various lengths that the center of the cloth attaching frame portion 65 of the nonstandard embroidery frame 51 mounted on the carriage of the dedicated embroidery frame transfer device at the position of an origin may be located at a predetermined position (e.g., at the position of the needle 5*a*).

As shown in 13, on the other hand, the attachment 52 includes a carriage connecting section 74 to be connected to the carriage 12, and a metal fastener 75 acting as the frame attaching portion for attaching the nonstandard embroidery frame 51. The carriage connecting section 74 has a construction substantially identical to that of the connecting section 54 of the standard embroidery frame 33, and its detailed description will be omitted by designating the common portions to those of the connecting section 54 by the common reference numerals.

In short, the carriage connecting section (as will be called the "connecting section") 74 is provided with the longitudinally long engaging projection 56 on its lower face and with a wall portion 76 at the front end portion of its lower face. Moreover, the connecting section 74 is provided at substantially right-hand half portion of its upper face with the stepped portion 57, which is provided on its upper face with the contact face 58 which is gently sloped downward from the right-hand side to the left-hand side.

At the right-hand end portion of the upper face of the stepped portion 57, there is disposed the guide portion 59, which includes the straight guide portion 60 and the curved guide portion 61. At the front end portion of the guide portion 59, on the other hand, there is formed the positioning recess 62. In the attachment 52, therefore, when the connecting section 74 is mounted on the carriage 12, the positioning projection 47 comes into engagement with the positioning recess 62, and the connecting section 74 is so locked by the carriage 12 as cannot slide. As a result, the positioning is made in the state where the longitudinally central portion of the connecting section 74 and the longitudinally central portion of the attaching block 32 of the carriage 12 are substantially aligned with each other.

In the left-hand side portion of the stepped portion 57, on the other hand, there are formed the cutout recesses 63, which are provided with the detected portions 64. The attachment can also be provided the three detected portions 64 at the maximum in a manner to correspond to the detect switches 48. In order to make a discrimination from the standard embroidery frame 33, however, the detected portions 64 are arranged in the connecting section 74 of the attachment 52 with a pattern different from that of the connecting section 54 of the standard embroidery frame 33. In the attachment 52 corresponding to the nonstandard embroidery frame 51 of FIG. 9, for example, one detected portion 64 is disposed at a rear position.

Moreover, the detected portions 64 are arranged for every kinds of the nonstandard embroidery frame 51 to be attached to the attachment 52. In a manner to correspond to the arrangement, the kind of the nonstandard embroidery frame 51 to be mounted, such as the size of the cloth attaching frame portion 65 is indicated at the front of the connecting section 74 of the attachment 52. Characters C of "18×13 cm" are indicated in the attachment 52 corresponding to the nonstandard embroidery frame 51 shown in FIG. 9, and characters C of "13×10 cm" are indicated in the attachment 52 corresponding to the nonstandard embroidery frame 51 shown in FIG. 10. Therefore, the user is enabled to confirm the kind of the nonstandard embroidery frame 51 to be mounted, by observing the characters C indicated on the attachment 52.

On the contrary, the metal fastener 75 is attached to an attaching bed 77 at the right-hand end portion of the connecting section 74, and is made of a longitudinally long plate member having an L-shaped section. At this time, a horizontal portion 78 at the lower side of the cover 75 is fixed to the lower portion of the attaching bed 77 of the connecting section 74 by means of a plurality of, e.g., three screws 79. To the longitudinally central portion of the metal fastener 75, moreover, there is fixed the root end portion of a disengagement preventing spring 80, which is formed by bending a spring member. The disengagement preventing leaf spring 80 is fixed to the attaching bed 77 together with the metal fastener 75 by the central one 79 of the three screws 79.

To the two longitudinal end portions of the upper vertical portion 81 of the metal fastener 75, on the other hand, there are fixed a pair of flanged pins 82, which extend horizontally outward. The flanged pins 82 are provided with flanged portions 83 at their leading end portions.

On the vertical portion 81 of the metal fastener 75 of the attachment 52, moreover, there is formed a projection 84, which projects outward. This projection 84 is so constructed as is fitted on at least one of the heads of the screws 68 when the nonstandard embroidery frame 51 is attached to the metal fastener 75. In the case of the attachment 52 corresponding to the nonstandard embroidery frame 51 of 180×130 mm, for example, the projection 84 is positioned at the longitudinally central portion of the vertical portion 81 of the metal fastener 75 and below the disengagement preventing spring 80.

Here will be described how to mount the nonstandard embroidery frame 51 on the carriage 12 through the attachment 52. The mounting of the nonstandard embroidery frame 51 on the carriage 12 is effected by the connection between the attaching block 32 of the carriage 12 and the connecting section 74 of the attachment 52 and by the connection between the metal fastener 75 of the attachment 52 and the connecting section 66 of the nonstandard embroidery frame 51. The connection between the attaching block 32 of the carriage 12 and the connecting section 74 of the attachment 52 is identical to the aforementioned action to mount the standard embroidery frame 33 on the carriage 12. Therefore, here will be described only the connection between the metal fastener 75 of the attachment 52 and the connecting section 66 of the nonstandard embroidery frame 51.

At first, the nonstandard embroidery frame 51 is pushed downward with the opening in the lower portion of its engaging recesses 73 being registered with the flanged portions 83 of the paired flanged pins 82 of the attachment 52. As a result, the flanged pins 82 are guided by the second cutout portions 71 into engagement with the engaging recesses 73 so that the nonstandard embroidery frame 51 is removably mounted on the metal fastener 75. At this time, if the nonstandard embroidery frame 51 of the correct kind is mounted on the attachment 52, the projection 84 of the metal fastener 75 is fitted on the head of the screw 68 of the nonstandard embroidery frame 51, as shown in FIG. 14. If the nonstandard embroidery frame 51 of an incorrect kind is to be connected to the attachment 52, on the contrary, the screws 68 are not positioned at the portions corresponding to the projection 84 of the metal fastener 75 so that the connection is hard to make. Therefore, the user can easily become aware that the combination between the nonstandard embroidery frame 51 and the attachment 52 is mistaken.

At this time, moreover, the disengagement preventing leaf spring 80 engages at its one end portion with the ridge portion 85 formed on the nonstandard embroidery frame 51 so that the engagement of the nonstandard embroidery frame 51 with the metal fastener 75 is held. In case the nonstandard embroidery frame 51 is to be removed, on the other hand, it can be easily disengaged by raising the embroidery frame 51 upward while pushing the disengagement preventing leaf spring 80 to the disengaged side with the finger.

By connecting the attachment 52 having the nonstandard embroidery frame 51 connected thereto, as described above, to the carriage 12, therefore, the nonstandard embroidery frame 51 can be mounted on the carriage 12.

According to this construction, even the nonstandard embroidery frame 51 of the type different in construction for attachment to the carriage 12 can be mounted on the carriage 12.

In this case, the nonstandard embroidery frame 51 is provided for each kind with the attachment 52, and the attachment 52 is provided at its connecting section 47 with the detected portions 64 to be detected by the detect switches 48 of the carriage 12. Therefore, the nonstandard embroidery frame 51 can be discriminated on its kind even if it is mounted through the attachment 52. Especially, the arrangement of the detected portions 64 of the attachment 52 and the arrangement of the detected portions 64 of the standard embroidery frame 33 are made different to make it possible to discriminate whether the embroidery frame mounted on the carriage 12 belongs to the standard embroidery frame 33 or the nonstandard embroidery frame 51.

On the other hand, the construction is so made that the center position of the sewing range may be identical, either in case the standard embroidery frame 33 is mounted on the carriage 12 at the origin position or in case the nonstandard embroidery frame 51 is mounted through the attachment 52 on the carriage 12 at the origin position. Even in case the nonstandard embroidery frame 51 is used, therefore, it is needless to consider the displacement of the center position due to the attachment 52. Merely by attaching the cloth to be embroidered as usually to the nonstandard embroidery frame 51, therefore, the embroidery pattern can be formed at a specific portion such as the central portion of the cloth.

Moreover, the nonstandard embroidery frame 51 to be mounted on the carriage 12 through the attachment 52 is made to have a smaller sewing range than that of the standard embroidery frame 33. Even in case the nonstandard embroidery frame 51 is mounted on the carriage 12 through the attachment 52, therefore, the sewing range of the nonstandard embroidery frame 51 will not extend over the intrinsic one of the embroidery frame transfer device 4.

In the case of a plurality of kinds of standard embroidery frames having frame portions of different sizes and shapes, on the other hand, the detect switches for detecting the detected portions at the connecting section of the standard embroidery frame may be disposed at the attaching portion of the carriage so that the kind of the standard embroidery frame mounted on the carriage can be detected.

According to the construction thus far described, the detected portions are detected by the detect switches, when the connecting section of the standard embroidery frame is connected to the connecting section of the carriage, so that the kind of the standard embroidery frame is detected. In short, the kind of the standard embroidery frame can be simply detected merely by mounting the standard embroidery frame on the carriage.

On the other hand, it is preferred that the attachment is provided for each of the kinds of the nonstandard embroidery frames, and the carriage connecting section is provided with the detected portions to be detected by the detection switches of the carriage, so that the kinds of the nonstandard embroidery frames connected to the attachment may be detected.

According to the construction thus far described, the attachments are provided for every kind of the nonstandard embroidery frames. When the connecting section of the attachment is connected to the attaching portion of the carriage, therefore, the detected portion is detected by the detection switch so that the kind of the attachment, i.e., the kind of the nonstandard embroidery frame is detected.

Moreover, the kind of the nonstandard embroidery frame to be connected may be indicated in the attachment, or the frame attaching portion of the attachment may be so constructed that the nonstandard embroidery frame of a kind different from that of the corresponding nonstandard embroidery frame is prevented from being connected thereto.

According to this construction, it is possible to prevent the kind of the nonstandard embroidery frame to be connected to the frame attaching portion of the attachment as much as possible from being mistaken.

On the other hand, the attachment may preferably be constructed such that the central position of the sewing range of the standard embroidery frame mounted on the carriage at the predetermined position may be identical to that of the sewing range of the nonstandard embroidery frame, which is mounted through the attachment on the carriage at the predetermined position.

When the nonstandard embroidery frame is mounted on the carriage through the attachment, the sewing range of the nonstandard embroidery frame is displaced to the extent of the attachment so that the central position of the sewing range of the nonstandard embroidery frame is displaced. In case the user forms the embroidery pattern at the predetermined portion of the cloth such as the central portion by using the nonstandard embroidery frame, therefore, the user has to attach the cloth to the frame portion of the nonstandard embroidery frame by estimating the displacement of the central position due to the attachment so that the operations become troublesome. Even in case the nonstandard embroidery frame is mounted on the carriage through the attachment, according to the aforementioned construction, the central position of the sewing range of the nonstandard embroidery frame and the central position of the sewing range of the standard embroidery frame become identical so that the displacement of the central position due to the attachment need not be taken into consideration.

Moreover, the standard embroidery frame is preferably constructed such that it may have a larger sewing range in at least one of the longitudinal direction and the transverse direction of movement by the transfer mechanism than that of the nonstandard embroidery frame.

When the nonstandard embroidery frame is mounted on the carriage through the attachment, its sewing range is displaced to the extent of the attachment. In case the sewing range of the standard embroidery frame is equal to or smaller than that of the nonstandard embroidery frame, therefore, the sewing range of the nonstandard embroidery frame extends over that intrinsic to the device, which has been set by estimating that the standard embroidery frame is mounted on the carriage. In case the nonstandard embroidery frame is used, therefore, the user has to attach the cloth to the frame portion by estimating the displacement due to the attachment so that the operations become troublesome. According to the aforementioned construction, on the contrary, the sewing range of the standard embroidery frame is made larger than that of the nonstandard embroidery frame. Even in case the nonstandard embroidery frame is mounted on the carriage through the attachment, therefore, it is possible to reduce or eliminate the protrusion of the sewing range of the nonstandard embroidery frame from that intrinsic to the device.

In the attachment embroidery frame transfer device for transferring the standard embroidery frame including the connecting section mounted removably on the carriage and adapted to be connected directly to the attaching portion of the carriage, and the frame portion for holding the cloth to be embroidered, on the other hand, the attachment to be removably mounted on the carriage is characterized by comprising: the frame attaching portion, to which the connecting section of the nonstandard embroidery frame having a structure different from that of the standard embroidery frame so that it cannot be connected directly to the attaching portion of the carriage is to be connected; and the carriage connecting section to be connected to the attaching portion of the carriage.

According to the aforementioned construction, it is possible to mount the nonstandard embroidery frame removably on the embroidery frame transfer device for the standard embroidery frame.

Here, the present invention should not be limited to the embodiment thus far described but can be suitably modified.

INDUSTRIAL APPLICABILITY

As apparent from the description thus far made, the embroidery frame transfer device of the present invention is provided with the attachment for mounting the nonstandard embroidery frame, as might otherwise be unable to be connected directly to the attaching portion of the carriage, on the attaching portion. Therefore, even the nonstandard embroidery frame having the connecting section different in structure from that of the connecting section of the standard embroidery frame can be mounted on the carriage to form an embroidery pattern on the cloth to be embroidered, thereby to increase the kinds of the embroidery frames to be used.

On the other hand, the attachment of the present invention includes the frame attaching portion, to which the connecting section of the nonstandard embroidery frame having the structure different from that of the standard embroidery frame, and the carriage connecting section to be connected to the attaching portion of the carriage. Therefore, the nonstandard embroidery frame can be removably mounted on the embroidery frame transfer device for the standard embroidery frame.

The invention claimed is:

1. An embroidery frame transfer device comprising:

a carriage including an attaching portion, the carriage capable of attaching a standard embroidery frame and a nonstandard embroidery frame, each frame including a connecting section that connects directly or indirectly to the attaching portion of the carriage and a frame portion for holding a cloth to be embroidered;

an attachment for mounting on the attaching portion a nonstandard embroidery frame having a connecting section of a structure different from that of the connecting section of the standard embroidery frame so that it cannot be connected directly to the attaching portion of the carriage;

wherein the attachment includes:

a frame attaching portion that connects to the connecting section of the nonstandard embroidery frame, and a carriage connecting section that connects to the frame attaching portion and the attaching portion of the carriage.

2. The embroidery frame transfer device as set forth in claim 1, wherein the attaching portion of the carriage includes detect switches that detect detected portions disposed at the connecting section of the standard embroidery frame when the standard embroidery frame is mounted on the carriage, and determines the type of the standard embroidery frame, the type of the standard embroidery frame differing in size and shape.

3. The embroidery frame transfer device as set forth in claim 2, wherein the attachment is provided for each type of nonstandard embroidery frame, and the carriage connecting section includes detected portions that are to be detected by the detect switches of the carriage so that the type of nonstandard embroidery frame connected to the attachment can be detected by the detect switches.

4. The embroidery frame transfer device as set forth in claim 3, wherein the attachment includes an indicating portion that indicates the type of nonstandard embroidery frame to be connected.

5. The embroidery frame transfer device as set forth in claim 3, wherein the frame attaching portion of the attachment includes a vertical portion having a projection provided in the center of the vertical portion, the projection configured to prevent the nonstandard embroidery frame of a kind different from the corresponding nonstandard embroidery frame from being connected thereto.

6. The embroidery frame transfer device as set forth in claim 1, wherein the attachment is constructed so that the central position of a sewing range of the nonstandard embroidery frame is identical to a central position of a sewing range of the standard embroidery frame, when the standard embroidery frame is mounted on the carriage at a predetermined position and the nonstandard embroidery frame is attached to the carriage by the attachment at the predetermined position.

7. The embroidery frame transfer device as set forth in claim 1, wherein the standard embroidery frame has a sewing range larger in at least one of the longitudinal direction and the transverse direction of movement by the transfer mechanism than the nonstandard embroidery frame.

8. An attachment to be removably mounted on a carriage of an embroidery frame transfer device, the embroidery frame transfer device configured to move a standard embroidery frame having a connecting section mounted removably on the carriage and adapted to be connected directly to the attaching portion of the carriage and a frame portion for holding a cloth to be embroidered, the attachment comprising:

a frame attaching portion that connects to a connecting section of a nonstandard embroidery frame having a structure different from that of the standard embroidery frame so that it cannot be connected directly to the attaching portion of the carriage; and a carriage connecting section that connects to the frame attaching portion and the attaching portion of the carriage.

9. An attachment in an embroidering machine to be removably mounted on a carriage of the embroidery machine, the carriage capable of attaching to a first embroidery frame having a first connecting section, the attachment comprising:

a carriage connecting section that connects to the carriage an embroidery frame attaching portion that is configured to engage with a second embroidery frame having a second connecting section of a shape different from that of the first connecting section so that it cannot be connected directly to the carriage; and a detected portion indicating that the second embroidery frame is mounted.

10. The attachment as set forth in claim 9, wherein the carriage has a detect switch that detects the detected portion thereby to detect the mounting of the second embroidery frame.

11. The attachment as set forth in claim 9, wherein the carriage has a positioning projection that is configured to engage with a positioning recess of the first embroidery frame when the first embroidery frame is mounted on the carriage, and configured to engage with a Positioning recess of the second embroidery frame when the second embroidery frame is mounted on the carriage.

12. The attachment as set forth in claim 9, wherein the second embroidery frame includes different kinds of embroidery frames, each kind of embroidery frame having an indicating portion for indicating the kind of the embroidery frame.

* * * * *